US005613621A

United States Patent [19]

Gervasi

[11] Patent Number: 5,613,621

[45] Date of Patent: Mar. 25, 1997

[54] INVENTORY CONTROL SHELF AID DISPENSING DEVICE

[76] Inventor: Paul Gervasi, 68, rue Denault, Kirkland (Québec), Canada, H9J 3X3

[21] Appl. No.: 427,189

[22] Filed: Apr. 24, 1995

[51] Int. Cl.[6] ..... B65H 1/08

[52] U.S. Cl. ..... 221/279; 33/758; 221/6

[58] Field of Search ..... 221/6, 2, 8, 226, 221/123, 279; 33/758

[56] References Cited

U.S. PATENT DOCUMENTS

| | | | |
|---|---|---|---|
| 1,226,055 | 3/1971 | Ciancimino | 33/758 |
| 2,079,754 | 5/1937 | Waxgiser | 312/71 |
| 2,522,896 | 9/1950 | Rifkin et al. | 312/71 |
| 3,348,732 | 10/1967 | Schwarz | 221/123 |
| 3,767,084 | 10/1973 | Bayha | 221/279 |
| 4,742,936 | 5/1988 | Rein | 221/5 |
| 5,012,936 | 5/1991 | Crum | 211/59.3 |

*Primary Examiner*—William E. Terrell
*Assistant Examiner*—T. Kelly
*Attorney, Agent, or Firm*—François Martineau

[57] ABSTRACT

A shelf aid dispensing device for periodic inventory control of commodity units in a displayed row. A rectangular panel with an elongated groove forms part of the device, the panel being adapted to be supported in horizontal condition over a flat bed. A draw bar is slidingly engaged into the groove for sliding displacement axially thereof, and is adapted for grasping engagement by an operator's hand. A slider plate is, slidingly carried to the panel and defines a flat abutment face for abutment by a rearwardmost commodity unit in the row. The slider plate may include ears in axial register with the draw bar rear rear portion, wherein the slider plate and the draw bar releasably interconnect and slidingly move together whenever the slider plate and the draw bar rear enlarged member come in abutting contact. Digit numbers appear on a self-adhesive peel-off strip laid lengthwisely over the draw bar, for enabling an operator to correlate the number of commodity units remaining in a partially depleted row, with an indicia value appearing at a selected location on the draw bar.

6 Claims, 2 Drawing Sheets

INVENTORY CONTROL SHELF AID DISPENSING DEVICE

FIELD OF THE INVENTION

This invention relates to article dispensing devices that allow periodic stacking of commodity units.

BACKGROUND OF THE INVENTION

U.S. Pat. No. 3,348,732 issued 24 Oct. 1967 to Heinz SCHWARZ, shows that is it known to provide an article dispensing device carried over a horizontal tray, for sliding displacement of a commodity unit over the tray through actuation of a slider block. The slider block is carried transversely of a transport bar, which can be pulled by a coupling member at the outer end of the transport bar. The inner end of the transport bar is slidingly mounted by an angle piece to a horizontal guide track, which is anchored at both ends to the stationary main frame of the dispensing device.

Such known article dispensing devices are useful in view of stacking or "grouping" scattered commodity units remaining in a partially depleted row of commodity units in a display counter, or alternately, in view of unloading these remaining commodity units from the display counter into a loading container in the walk-through alley for the customer. However, for inventory control purposes, it is time-consuming and error-prone to compute—by visual inspection—the number of remaining commodity units in the row, by counting each and every such commodity unit on display.

OBJECT OF THE INVENTION

The main object of the invention is therefore to address the need for facilitating inventory control of low-cost commodity units, in grocery stores and the like.

SUMMARY OF THE INVENTION

In accordance with the object of the invention, there is disclosed a shelf aid dispensing device for periodic inventory control of commodity units in a displayed row, comprising: (a) an elongated main panel member, defining front and rear ends and a groove extending therebetween, said stationary main panel member adapted to be supported in horizontal condition over a flat bed; (b) an elongated draw bar, sized to fit into said main panel groove and slidingly engaged therein for sliding displacement axially thereof, and defining a front end, for grasping engagement by an operator's hand, and an integral rear enlarged member; (c) means for preventing accidental release of said draw bar transversely outwardly from said groove; (d) a slider member, slidingly carried to said main panel member and defining a flat abutment face for abutment by a rearwardmost commodity unit in said row of commodity units, said slider member flat abutment face extending transversely of said main panel groove, said slider member and said draw bar releasably interconnecting and moving together whenever said slider member and said draw bar rear enlarged member come in abutting contact; and (e) indicia means, carried lengthwisely of said draw bar for enabling an operator to correlate the number of commodity units remaining in a partially depleted row, with an indicia value appearing at a selected location on the draw bar.

Preferably, said indicia means consists of successive digit numbers, and further including window means, mounted to said main panel member for assisting in the visual inspection of the selected digit number carried by said draw bar and correlated to said remaining number of commodity units in the row. Said indicia means digit number could be carried by a flexible self-adhesive peel-off strip, fixedly adhered to a lengthwise surface of said draw bar.

The front end of said draw bar could be smoothly arcuate, for facilitating manual handling thereof.

A trailing arm could also be provided, being transversely carried by said slider member and projecting rearwardly therefrom, said trailing arm defining a transversely inturned free end tip, said trailing arm tip frictionally engaging said main frame panel for improving dynamic smoothness of the slider member upon the slider member being pushed manually by the user toward the main panel rear end. This trailing arm tip would preferably be of pyramidal shape, and said draw bar enlarged rear end includes an intermediate notched area in axial register with the trailing arm tip, said notched area forming a pair of opposite transverse ramps sized for complementary fit with said pyramidal trailing arm tip, said ramps being slidingly frictionally engageable by said trailing arm tip upon the latter striking and moving over said intermediate notched area of the draw bar enlarged rear end, wherein trailing arm becomes accordingly tilted temporarily spacedly away from said main frame panel.

It would be envisioned to add a rear socket, being fixedly mounted to said main frame panel rear end, whereby a rear limit sliding position of said slider member is defined when said draw bar enlarged rear member is taken in sandwich between said rear socket and said slider member.

Inversely U-shape channels could also be carried at each of the front and rear ends of said elongated main panel, for securing said main panel front and rear ends horizontally to the upright edge portions of a display counter frame.

Preferably, said means for preventing accidental transverse release of said draw bar from said groove includes a sleeve member, fixedly mounted transversely to said main panel and spacedly proximate said main panel front end and spacedly straddling said groove; said sleeve member further forming a raised step constituting a front limit sliding position for said slider member when said slider member is brought forwardly.

DETAILED DESCRIPTION OF THE DRAWINGS

Figure 1:
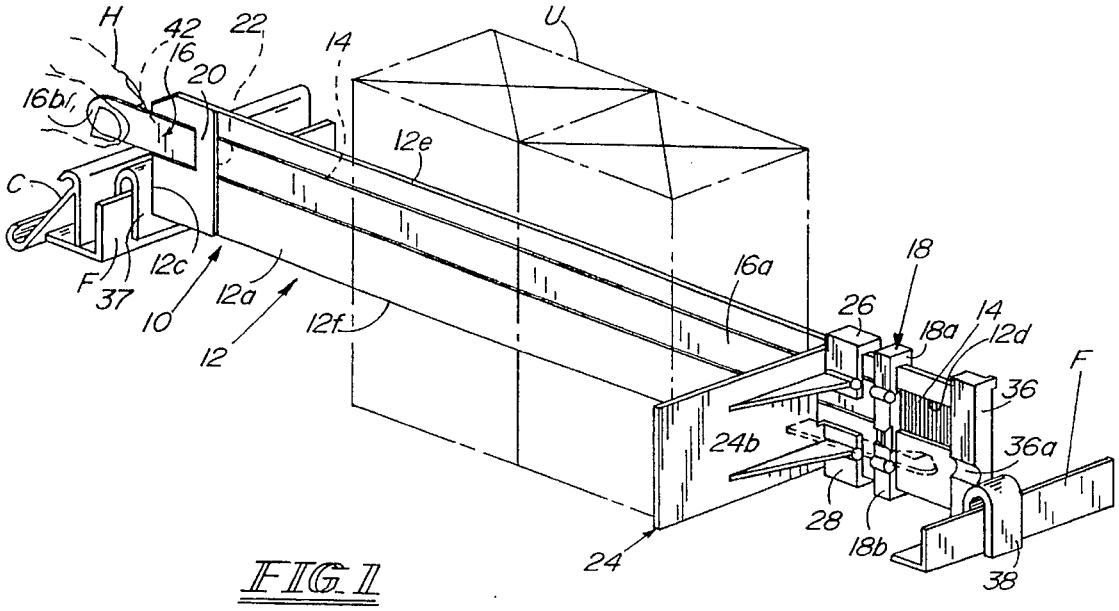
FIG. 1 is an isometric view of an inventory control shelf aid dispensing device according to the invention, showing how a user's hand can operate the draw bar to pull two commodity units.
Figure 2:
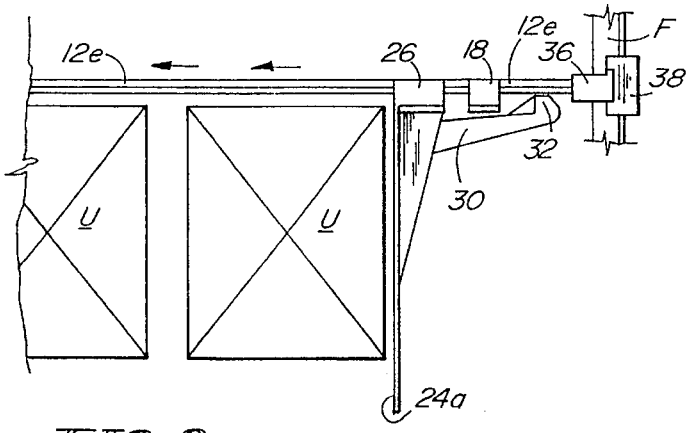
FIGS. 2 and 3 are fragmentary top plan views of the dispensing device of FIG. 1, sequentially suggesting how the two commodity units can be displaced by the slider plate.
Figure 3:
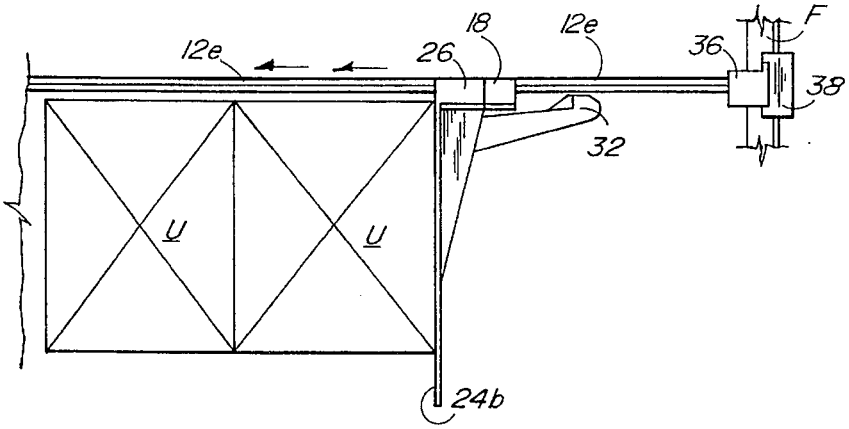

The inventory control shelf aid dispensing device is generally illustrated in FIGS. 1–3 and referenced 10, to include a main rigid frame 12 in the shape of a rigid rectangular panel. A lengthwise rectangular groove 14 is made on a first face 12*a* of panel 12, said groove 14 opening at both opposite ends 12*c*, 12*d*, of panel 12. A draw bar 16 is slidingly engaged into said groove 14, and is cross-sectionally sized to substantially fully fit therein. A C-shape clamp 18 is fixedly mounted to the inner end 16*a* of draw bar 16, and is applied flatly against the panel first face 12*a*. The C-clamp 18 forms top and bottom arcuate tracks 18*a*, 18*b*, that slidingly grip the top and bottom edges 12*e*, 12*f*, of panel 12, to keep clamp 18 attached at all times to the panel 12 and continuously retaining the draw bar inner end 16*a* inside the groove 14, while enabling free sliding motion of the clamp 18 lengthwisely of the panel 12. Thus, clamp 18 moves with draw bar 16. Panel 12 further includes an integral sleeve segment 20 extending spacedly over the front portion of groove 14, whereby a passage 22 is formed between the sleeve segment 20 and the registering groove section 14 for free sliding displacement of draw bar 16. Sleeve segment 20 has the same purpose as C clamp 18, namely, to keep a corresponding portion of draw bar 16 inside the groove 14. The draw bar outer end 16*b* is preferably of smooth arcuate shape, to enable comfortable handling by the thumb and forefinger of a user's hand H.

A slider plate 24 is transversely carried to panel 12 against panel face 12*a* by a pair of integral arcuate ears 26, 28, that slidingly grip the panel edges 12*e*, 12*f*, in the same general way as the arcuate edges 18*a*, 18*b*, of the clamp 18. Slider plate 24 is free to slide along panel 12, between clamp 18 and the sleeve segment 20. Clamp 18 and sleeve segment 20 form opposite seats against which are alternately abuttable the slider plate arcuate ears 26, 28, for preventing sliding motion of the clamp 18 therebeyond. Slider plate 24 defines a flat smooth face 24*a*, extending generally perpendicularly to rectangular flat panel 12 and in the direction of sleeve segment 20, for abutting contact with a commodity unit U.

When the draw bar 16 is pulled along groove 14 to displace slider plate 24 forwardly toward plate end 16*b* in order to stack the remaining commodity units in the partially depleted row of goods, slider plate 24 moves transversely therealong in a reasonably smooth fashion, since the connecting point of draw bar 16 to slider plate 24 is located at the innermost edge portion of the slider plate 24 relative to the frame panel 12. On the contrary, when the slider plate 24 is manually grasped and pushed back to its rearwardmost location adjacent the main panel rear end 12*d*, the smoothness of sliding motion of the slider plate is compromised due to the fact that some lever arm torque is applied thereto. Lever arm torque exists, because the user's hand H will normally grasp the outermost free edge of the slider plate 24, i.e., at a location on the slider plate 24 farthest from panel 12, wherein a tilting force will be applied to ears 26 and 28 transversely to their axis of displacement. Such tilting force will have a tendency to stall the rearwardly moving slider plate 24 and undesirably lock same to the panel 12, before the slider plate 24 reaches its rearwardmost limit position adjacent the plate rear end 12*d*.

To counteract this undesirable lever arm torque, a trailer arm 30 is preferably mounted transversely of the slider plate 24. Trailer arm 30 projects from the inner end of face 24*b* opposite pusher face 24*a* and proximate ears 26 and 28. Trailer arm 30 includes an inturned pyramidal lip 32 having an innermost edge 32*a* that slidingly engages frictionally against the main panel smooth face 12*a* (slightly beneath groove 14). Trailer arm lip 32 provides a sliding seat for improving smoothness during the sliding motion of slider plate 24, when slider plate 24 is slidingly pushed manually to the rear end 12*d* of the main frame panel 12 (after a row of commodity units U has been fully depleted and restocking of commodity units U alongside the main frame panel 12 is required). Thus, trailer arm 30 prevents in particular the slider plate 24 from dynamically stalling and accidentally locking to main panel 12 at an intermediate distance from the panel rear end 12*d*, to accommodate the tolerance or play defined by the gap between the C-shape channels of the slider plate ears 26 and 28 and the top and bottom edge portions 12*e*, 12*f*, of the main panel 12.

Figure 4A:
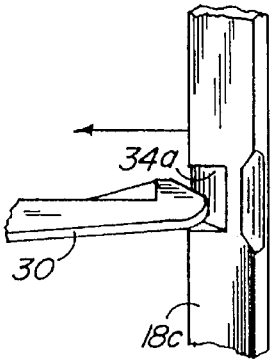
FIGS. 4*a*, 4*b* and 4*c* are enlarged views of the trailer arm of the draw bar slider plate, suggesting how the trailer arm end tip can come to slidingly overlap the C-shape clamp at the draw bar inner end.
Figure 4B:
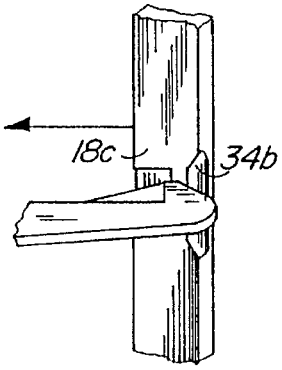
Figure 4C:
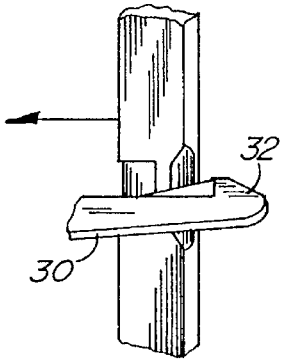

An important consideration for trailer arm 30 is that it should be able to move freely over the end clamp 18 of draw bar 16. However, the main leg 18*c* of clamp 18 extends over the grooved face 12*a* of main frame panel 12, thus creating an obstacle to the trailer arm lip 32 which otherwise abuts against the main frame panel face 12*a*. In view thereof, and as sequentially shown in FIGS. 4*a*–4*c*, there is provided a pair of registering notches 34*a*, 34*b*, made intermediately of the clamp main leg 18*c*, and sized and located for engagement by the trailer arm lip 32. Each notch 34*a*, 34*b*, therefore forms an inclined ramp axially of the draw bar 16. Thus, upon rearward displacement of the slider plate 24 toward the rear end 12*d* of the main frame plate 12, trailing arm 30 will eventually strike clamp 18. Ramp 34*a* will enable the trailer arm lip 32 to temporarily tilt or lift away from panel face 12*a*, to clear and slide frictionally over and beyond the clamp main leg 18*c*. Accordingly, the U-channel formed by the slider plate ears 26, 28, must have some sufficient play to enable some measure of tilt of the slider plate 24 away from its normal plane perpendicular to the main frame panel 12. After the trailing arm 30 has cleared the clamp 18, it moves rearwardly thereof until the slider plate ears 26, 28, come to abut against the draw bar arcuate edges 18*a*, 18*b*.

Thereafter, the draw bar 16 can be manually pulled at rounded end 16*b*, drawing forwardly therewith the slider plate 24. During this pulling motion, scattered commodity units U remaining within the row are brought forward and stacked horizontally against one another, until the forwardmost unit U reaches and abuts against the alley edge of the display counter C. The draw bar 16 then extends at least partially across the grocery store alley along which the consumers stroll for browsing through the commodity units on display. Upon release of the pulling force on draw bar 16, the draw bar 16 can be pushed back to its rear concealed condition, to clear the walk-through alley of the grocery store. When the drawbar 16 is pushed back rearwardly, the main leg 18*c* of the clamp member 18 (at the rear end of the drawbar) strikes the trailing arm lip 32. Thanks to the other notch ramp 34*b* of the clamp member 18, the trailer arm lip 32 will again be temporarily tilted i.e. lifted away from panel face 12*a*, whereby the clamp main leg 18 will be able to clear and slide frictionally between the trailing arm lip 32 and the main panel face 12*a*, and rearwardly therebeyond.

The forwardmost position of the slider plate 24 (i.e., that position closest to the consumer walk-through alley transverse to the elongated panel 12), is defined by the sleeve member 20, which forms a raised step transversely of the panel 12 against which step the slider plate 24 will edgewisely abut, and which straddles groove 14. A similar stop member should preferably be provided at the rear end of the main frame panel 12, to limit the rearward displacement of the slider plate 24. This rear stop member may consist of a simple thick socket 36 (FIG. 1), fixedly applied against the rear end 12*d* of the main panel 12, wherein a peripheral step is formed against which the clamp member 18—taken in sandwich between the slider plate 24 and the socket 36—will come to abut.

It is understood that support means are envisioned for supporting rectangular thin flat panel 12 in both a horizontally extending condition (transversely to the walk-through alley of the grocery store) and within an upright plane (for supporting the commodity units U in upright conditions). These support means may consist of a pair of inversely U-shape channel members 37, 38, carried at the bottom portion of the front and rear edges 12*c*, 12*d*, respectively of the main frame panel 12. Each of these channel members 37, 38, is adapted to fit edgewisely over the top upright leg of a cross-sectionally L-shape frame member F forming an integral part of a display counter, such display counter frame member F not forming part as such of the present invention. Moreover, the commodity units U will obviously have to be supported in their respective rows by a flat horizontal bed (not shown), mounted integral to the display counter frame.

Figure 5:
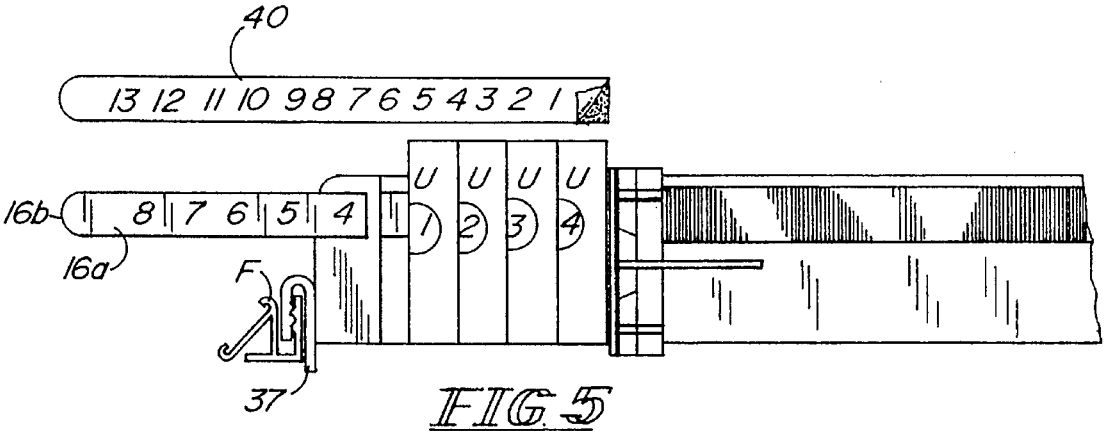
FIG. 5 is a fragmentary side elevational view of the front end portion of the dispensing device, suggesting how an adhesive peel-off strip bearing successive printed numbers can be glued to the draw bar front end portion to enable the user to visually correlate the number of remaining commodity units to an adhesive strip printed number appearing in a window adjacent the main frame front end.

According to the invention, indicia means 40 are carried by the interior face 16*c* of draw bar 16, for correlating the number of commodity units U remaining between slider plate 24 and the front end 37 of the panel 12, with an indicia value. Preferably, the indicia means consists of a self-adhesive flexible strip, applied lengthwisely against the draw bar 16 and carrying a series of lengthwisely spaced successive numbers, which progressively increase starting with number one proximate the rear clamp end 18 of the draw bar 16, to the largest number, e.g. number fourteen, proximate the opposite free rounded end 16*b* of the draw bar 16. To assist in reading the selected number on the draw bar 16 corresponding to the number of commodity units U remaining in the partially depleted row, a closed, e.g. quadrangular window (not shown) is preferably made through the front portion of the wall 12*a* of main frame panel 12, in register with sleeve member 20 and opening into lengthwise groove 14. Thus, an operator looking at the front end portion of the panel face 12*a* (on the side opposite slider plate 24) will immediately discover, by simple inspection of the number appearing in the window, how many commodity units U still remain inside the row, simply by pulling the draw stick 16 to bring all remaining commodity units frontwardly against one another. At that point, the user will feel that the draw bar 16 is stopped, i.e. cannot be pulled further forwardly. It is at that point, when the draw bar 16 extends transversely to its forwardmost position, that lecture of the number inside window 42 has to be taken. After the operator has recorded that value, the draw bar 16 is pushed and returned to its rearwardly concealed condition. Alternately, the indicia means 40 could also be applied against the exterior face 16*a* of the draw bar, as shown in FIG. 5, with the sleeve member 20 forming the rear side edge of an open forward window 42.

It is therefore easily understood how periodic, e.g. daily, inventory control of commodity units U can be substantially facilitated by this simple technique: no computation is involved, only a simple visual inspection of a number appearing in a window, and recordal of this number.

Preferably, and as illustrated in FIG. 1, socket 36 includes a transverse slit 36*a*, in axial register with the trailing arm 30 of the slider plate 24 and in tangential register with the web of rear U-channel 38. Hence, as the slider plate 24 is moved rearwardly toward socket 36, the trailing arm lip 32 will eventually engage through the socket slit 36*a* and slidingly over the arcuate web of the underlying inversely U-shape U-channel 38.

All the elements constituting the present inventory control device (except the flexible indicia means self-adhesive peel-off strip 40) should be made from a smooth, rigid material, of very low manufacturing cost, e.g. an injection-molded plastic material. Strip 40 could be made from a waterproof paper material coated with a suitable plastic compatible glue compound.

Preferably, the rectangular main frame panel 12 will have means for adjusting its length. Such length-adjusting means could consist e.g. of a number of frangible transverse sections (not shown), made in lengthwisely spaced successive fashion along panel 12, whereby its effective length can be selected by breaking the panel 12 at a desired length about a corresponding frangible wall section. Similar length-adjusting means would then be envisioned for the draw bar 16.

It is understood that such main frame panel 12 and associated elements 16, 24, . . . would be fixedly secured in position inside the display counter, transversely of the walk-through alleys for the customers, for a long period of time. A plurality of such devices 10 are envisioned to be positioned in transversely horizontally spaced fashion, and also in vertical staggered fashion, with each series of horizontally registering panels 12 standing over a common underlying bed for supporting the commodity units U inside a row. Of course, the support bed (not shown) need not be exactly horizontal, since it could be inclined slightly downwardly toward the walk-through alley of the drugstore or grocery store. Also, such devices 10 could be easily removed from the display counter C, simply by having the U-channels 37, 38, release the L-frames F, F, of the display counter C, e.g. for cleaning the same.

I claim:

1. A shelf aid dispensing device for periodic inventory control of commodity units in a displayed row, comprising:

(a) an elongated main panel member, defining front and rear ends and a groove extending therebetween, said main panel member adapted to be fixedly supported over a flat underlying bed for supporting the commodity units in upright position;

(b) an elongated draw bar, sized to fit into said main panel groove of the stationary main panel and slidingly engaged therein for sliding displacement axially thereof, and defining a front end, for grasping engagement by an operator's hand, and an integral rear enlarged member;

(c) a slider member, slidingly carried to said main panel member and defining a flat abutment face for abutment by a rearwardmost commodity unit in said row of commodity units, said slider member flat abutment face extending transversely of said main panel groove, said slider member and said draw bar releasably interconnecting and moving together whenever said slider member and said draw bar rear enlarged member come in abutting contact;

(d) indicia means, carried lengthwisely of said draw bar for enabling an operator to correlate the number of commodity units remaining in a partially depleted row, with an indicia value appearing at a selected location on the draw bar; and (e) a trailing arm, transversely carried by said slider member and projecting rearwardly therefrom, said trailing arm defining a transversely inturned free end tip, said trailing arm tip frictionally engaging said main frame panel for improving dynamic smoothness of the slider member upon the slider member being pushed manually by the user toward the main panel rear end;

wherein said trailing arm tip is a pyramidal shape, and said draw bar enlarged rear end includes an intermediate notched area in axial register with the trailing arm tip, said notched area forming a pair of opposite transverse ramps sized for complementary fit with said pyramidal trailing arm tip, said ramps being slidingly frictionally engageable by said traillling arm tip upon the latter striking and moving over said intermediate notched area of the draw bar enlarged rear end, wherein said trailing arm becomes accordingly tilted temporarily spacedly away from said main frame panel.

2. A shelf aid dispensing device as defined in claim 1, wherein said indicia means consists of successive digit numbers, and further including window means, mounted to said main panel member for assisting in the visual inspection of the selected digit number carried by said draw bar and correlated to said remaining number of commodity units in the row.

3. A shelf aid dispensing device as defined in claim 1, wherein the front end of said draw bar is smoothly arcuate, for facilitating manual handling thereof.

4. A shelf aid dispensing device as defined in claim 1, further including inversely U-shape channels, carried at each of the front and rear ends of said elongated main panel, for securing said main panel front and rear ends horizontally to the upright edge portions of a display counter frame.

5. A shelf aid dispensing device as defined in claim 2, wherein said indicia means digit number are carried by a flexible self-adhesive peel-off strip, fixedly adhered to a lengthwise surface of said draw bar.

6. A shelf aid dispensing device for periodic inventory control of commodity units in a displayed row, comprising:

(a) an elongated main panel member, defining front and rear ends and a groove extending therebetween, said main panel member adapted to be fixedly supported over a flat underlying bed for supporting the commodity units in upright position;

(b) an elongated draw bar, sized to fit into said main panel groove of the stationary main panel and slidingly engaged therein for sliding displacement axially thereof, and defining a front end, for grasping engagement by an operator's hand, and an integral rear enlarged member;

(c) a slider member, slidingly carried to said main panel member and defining a flat abutment face for abutment by a rearwardmost commodity unit in said row of commodity units, said slider member flat abutment face extending transversely of said main panel groove, said slider member and said draw bar releasably interconnecting and moving together whenever said slider member and said draw bar rear enlarged member come in abutting contact;

(d) indicia means, carried lengthwisely of said draw bar for enabling an operator to correlate the number of commodity units remaining in a partially depleted row, with an indicia value appearing at a selected location on the draw bar; and (e) means for preventing accidental release of said draw bar transversely outwardly from said groove, including a sleeve member, fixedly mounted transversely to said main panel and spacedly proximate said main panel front end and spacedly straddling said groove; said sleeve member further forming a raised step constituting a front limit sliding position for said slider member when said slider member is brought forwardly.

* * * * *